United States Patent [19]

Sweeton

[11] 4,027,646

[45] June 7, 1977

[54] PROPULSION DEVICE FOR TENNIS BALLS AND LIKE SPHERICAL OBJECTS

[75] Inventor: Gerard F. Sweeton, Skillman, N.J.

[73] Assignee: Prince Manufacturing, Inc., Princeton, N.J.

[22] Filed: June 8, 1976

[21] Appl. No.: 694,119

[52] U.S. Cl. ..... 124/56; 124/41 R; 124/48; 124/50

[51] Int. Cl.[2] ..... F41F 1/04

[58] Field of Search ..... 124/41 R, 45, 48, 49, 124/50, 51 R, 52, 53, 56

[56] References Cited

UNITED STATES PATENTS

| | | | |
|---|---|---|---|
| 2,646,785 | 7/1953 | Goldman | 124/51 R X |
| 3,277,879 | 10/1966 | Sayette | 124/41 R X |
| 3,584,614 | 6/1971 | Horvath | 124/56 |
| 3,855,988 | 12/1974 | Sweeton | 124/50 X |
| 3,905,349 | 9/1975 | Nielsen et al. | 124/41 R X |
| 3,917,265 | 11/1975 | Schrier et al. | 124/48 X |
| 3,990,426 | 11/1976 | Stokes | 124/56 |

*Primary Examiner*—Richard T. Stouffer
*Attorney, Agent, or Firm*—Sperry and Zoda

[57] ABSTRACT

A propulsion device is provided, designed especially for discharging tennis balls for practice purposes, at selected angles of inclination, and at a predetermined, selected velocity. Employed in the device is a distributor, which is disposed between a hopper and an air pressurizing drum, the distributor being designed to feed balls, one at a time, to the drum, at predetermined intervals.

The distributor is disposed between the hopper and drum in such fashion as to cause the spherical objects to be efficiently agitated within the hopper, by passage over the exteriorly cylindrical surface of the drum while moving to the point at which the objects feed into the drum. Efficient agitation of the spherical objects within the hopper thus assures to the maximum extent that the distributor will be fully charged with said objects.

A trap door, normally closed by air pressure within the drum, is moved with maximum speed to an open position responsive to the free fall of a spherical object from the distributor into the drum, and moves with equal speed back to a closed position. By holding the open time of the trap door to a minimum, it becomes possible for the device to be interiorly constructed with a simple receiving pipe characterized by an absence of annular induced air flow assemblies and other arrangements which have heretofore been employed.

14 Claims, 9 Drawing Figures

PROPULSION DEVICE FOR TENNIS BALLS AND LIKE SPHERICAL OBJECTS

BACKGROUND OF THE INVENTION

1. Field of the Invention

The invention relates generally to devices that propel forcibly, into the air, spherical objects such as tennis balls or the like, in selected, adjusted trajectories, for practice or training purposes.

2. Description of the Prior Art

It is well known to provide propulsion devices for tennis balls and like spherical objects. It is also known to employ a pressure build-up, within a chamber to which the tennis balls are fed, in such fashion as to cause the tennis balls to be forcibly propelled from a barrel located at a selected angle of inclination, after being temporarily arrested by a detent within the barrel. In the prior art, thus, it has been well known to cause automatic feeding of the tennis balls to the drum or pressurizing chamber, with the intention of causing the balls to be propelled at prescribed, uniform intervals. Such devices as have heretofore been conceived for this purpose, however, have in general been comparatively expensive, and despite the relative complexity and expensiveness of construction thereof, have been unfortunately characterized, in many instances, by a lack of full efficiency. Thus, in some instances the feeding of the tennis balls has been irregular, in that the timed feeding devices, employed for the purpose of feeding the tennis balls into the pressurizing drum, have not operated in such fashion as to be completely charged or loaded with tennis balls as they approach the ball feeding position.

It has further been a characteristic of the prior art that complex mechanisms have been needed within the drum, as for example, it has been characteristic of tennis ball propulsion devices that air flow is induced into the discharge tube or barrel, through an annular chamber surrounding the barrel, a construction which has been made necessary due to excessive open time for the trap door or similar closure located at the entrance to the pressurizing drum.

Typical of the prior art devices is the propulsion device shown in Nielsen U.S. Pat. No. 3,905,349 issued Sept. 16, 1975.

SUMMARY OF THE INVENTION

Summarized briefly, the present invention includes an elongated drum disposed when in use at a position slightly inclined from the horizontal, and formed to a circular cross-section in a preferred embodiment. Above and in closely spaced relation to the drum is a hopper designed to receive a large supply of tennis balls or like spherical objects intended to be propelled from the device. A distributor is mounted for rotation in the bottom of the hopper, and includes an annular series of ball feed sleeves, extending about the axis of rotation of the distributor in such fashion as to cause each ball feed sleeve to move into position over a ball feed opening formed in the top of the drum. The distributor is rotated at a selected, relatively slow rate of speed, and in accordance with the invention anti-bridging and agitating means is incorporated in the distributor within the hopper, to aid in preventing the balls from lodging in a static position in which they will not feed, one after the other, into successively following openings provided in the ball feed sleeves of the distributor.

Further summarized, the invention has a gravitational feed pipe closed at its lower end by a trap door that is normally retained in closed position by a built-up air pressure within the drum or pressurizing chamber. The kinetic energy of a ball having free fall through the feed pipe or tube in effect snaps the door to open position, but only for an instant, because the ball falls freely past the trap door to an inclined ramp, in such a way as to almost instantaneously clear the door so that the door can be returned with equal speed to its closed position by the air pressure within the chamber.

The ball rolls down the ramp to a receiver tube, being moved therealong by air pressure building up in back of the ball, until the ball is temporarily arrested by a rubber detent which per se is known in the art. When the pressure within the chamber in back of the ball builds up to a predetermined value, the ball is forcibly discharged through the barrel, which is adjusted to a selected angle of inclination before the propulsion device is placed in operation.

DESCRIPTION OF THE PREFERRED EMBODIMENT

Figure 1:
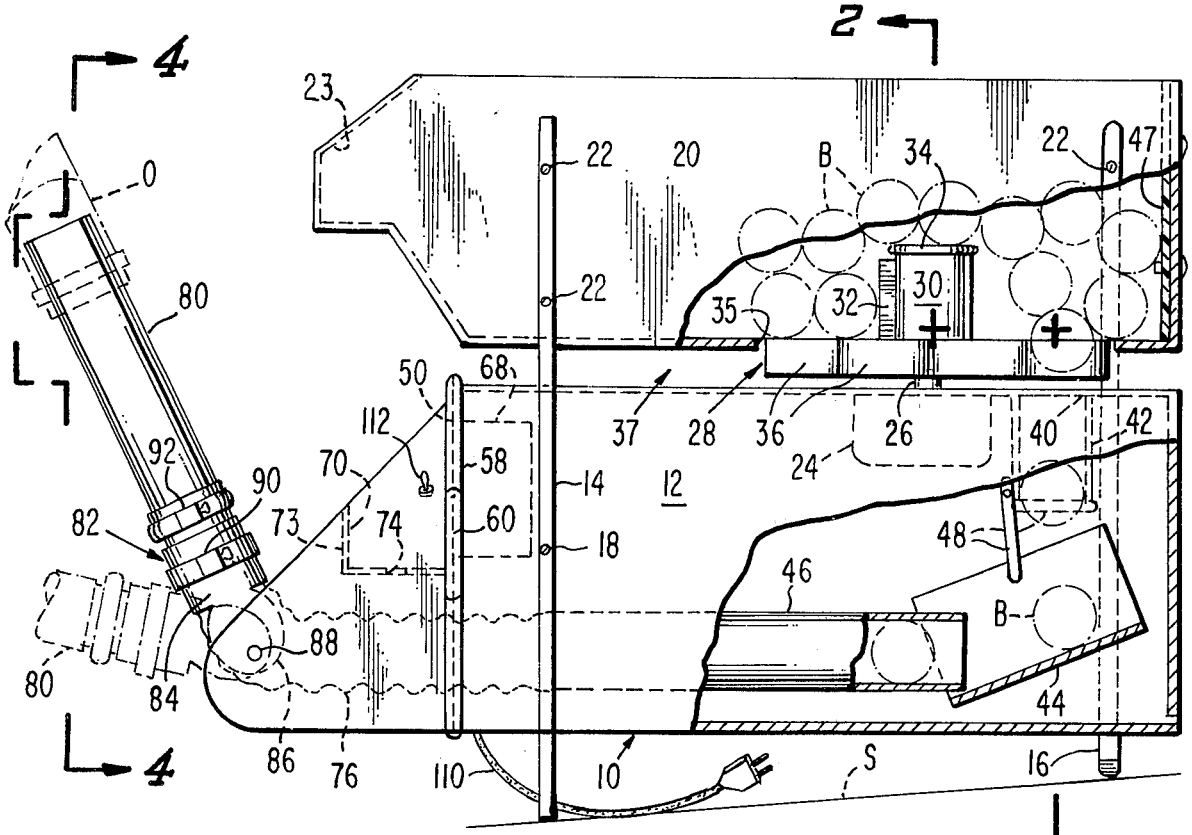
FIG. 1 is a view of a propulsion device according to the present invention, partly in side elevation and partly in longitudinal section, the barrel being shown in full and dotted lines in typical positions to which it can be adjusted.
Figure 4:
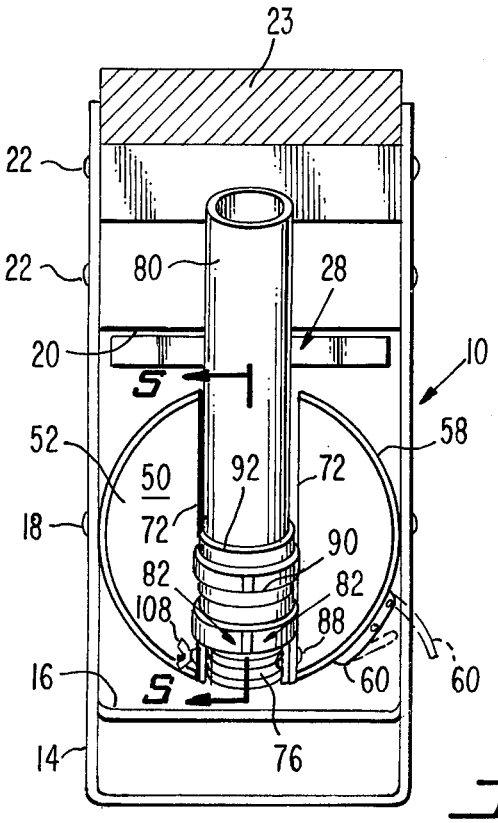
FIG. 4 is a front end view of the device, as seen from the line 4—4 of FIG. 1.
Figure 9:
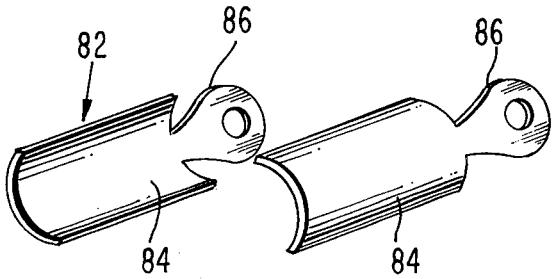
FIG. 9 is an exploded perspective view of the barrel support plates.

My ball propulsion device 10 includes a cylindrical, large diameter housing or pressurizing chamber 12 of circular cross-section, supported above the ground or other supporting surface S in a position inclined a few degrees from the horizontal through the provision of front and rear, U-shaped support legs 14, 16 respectively disposed in embracing relation to the chamber 12 and riveted, bolted, or otherwise secured to said chamber as at 18. The side portions of the U-shaped support legs 14, 16 project upwardly above housing or chamber 12, in embracing relation to an elongated, generally rectangular hopper 20, to which the supports are riveted or otherwise fixedly secured at 22. Hopper 20 is formed wholly open at its top, to receive a large supply of tennis balls B. The front end of the hopper is provided with a screen 23, mounted in position to retain a sound-deadening material in an air intake chamber to be described hereinafter.

Mounted within housing 12, intermediate the opposite ends thereof, is a gear motor 24, secured fixedly to the top portion of housing 12, and having a stub shaft 26 projecting upwardly to engage, for rotation with the stub shaft, a depending hub 27 of a distributor 28 preferably formed as an integral, molded plastic member to include a centrally disposed, upstanding, hollow, large diameter boss or projection 30 extending upwardly within the hopper to prevent "bridging" of balls within the hopper and formed with uniformly, angularly spaced, longitudinally extending, radially projecting agitator ribs 32. Projection 30 is made hollow to promote economy in molding, and to increase lightness of the distributor, but in use the hollow center is closed by a cap 34. The distributor projection 30 extends upwardly into the hopper in concentric relation to an opening 35 formed in the bottom of the hopper for receiving the distributor, and when rotated during operation of the gear motor will agitate the balls continuously and will prevent bridging thereof, to assure that they will fall into the several, uniformly angularly spaced distributor sleeves 36 disposed about the projection 30 at the base thereof in a circular pattern, and located (FIG. 1) in an open space 37 defined between the hopper 20 and the pressurizing chamber 12. Any one or more of sleeves 36 may be closed by removable caps 38.

Figure 2:
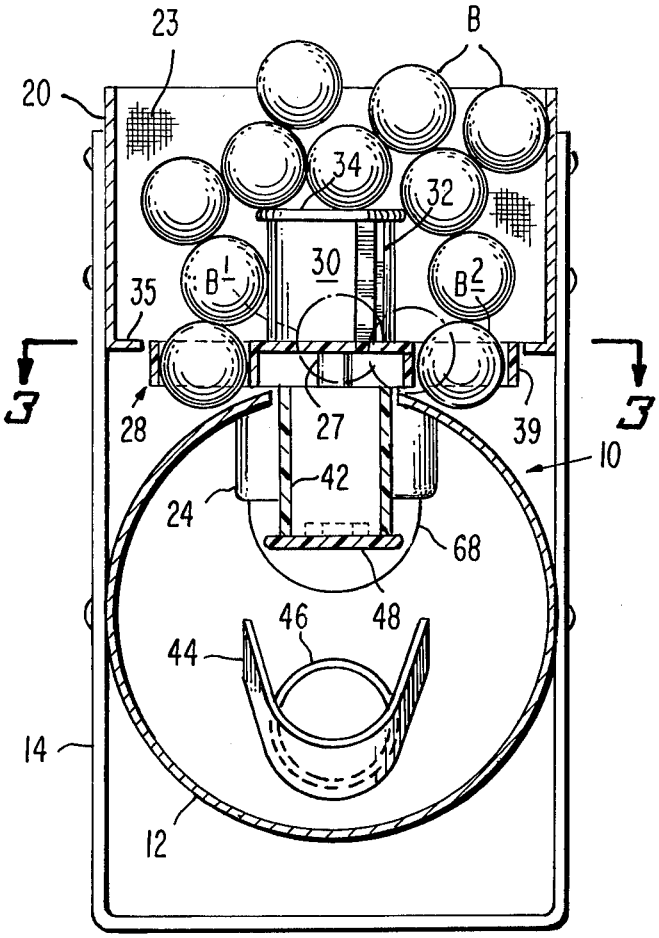
FIG. 2 is an enlarged, transverse sectional view, substantially on line 2—2 of FIG. 1.
Figure 3:
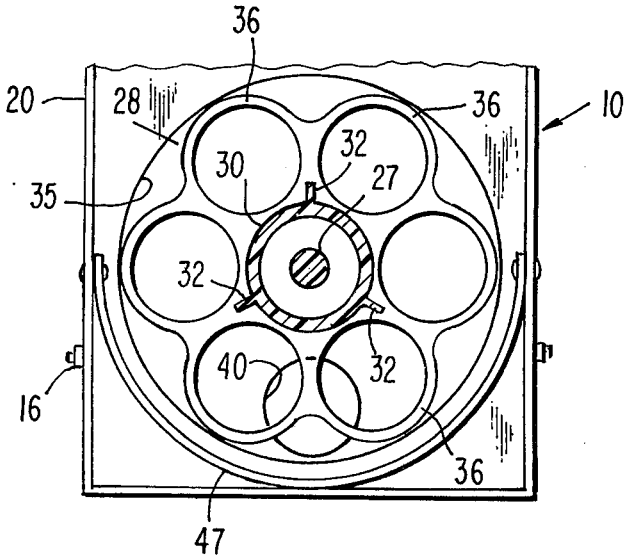
FIG. 3 is a fragmentary, horizontal sectional view, substantially on line 3—3 of FIG. 2.

Referring to FIG. 2, disposition of the distributor base 39, comprised of the several integrally connected sleeves 36, the full height of the space between the top wall of the drum or chamber 12, locates the base substantially tangentially to the curvature of said top wall. As a result, balls loading into the sleeves contact the curved top surface of the wall of the drum. As the distributor turns, the balls so loaded are cammed or biased upwardly and downwardly along paths parallel to the distributor axis between high points $B^1$- and low points $B^2$- respectively, by the curved wall surface of the drum. They may at the same time be rotated, but primarily, their up-and-down motion in the sleeves causes them to agitate the tennis balls that are above but have not yet reached the distributor. This aids markedly in assuring against "skipping" of distributor sleeves, that is, increased assurance is provided for the feeding of balls into the drum at the regular intervals for which the machine is pre-set.

Formed in the top portion of chamber 12, between gear motor 24 and the closed rear end of chamber 12, is a feed opening 40, in registration with a depending, open ended, ball feed sleeve 42 fixedly secured to the wall of chamber 12 in position extending substantially vertically downwardly therein in close proximity to the gear motor and the rear end wall of the chamber. Balls B feeding gravitationally through sleeve 42 drop onto a ramp or feed channel 44 of U-shaped cross-section, declining forwardly toward and fixedly mounted upon the rear end of an elongated receiver tube 46 extending parallel to the longitudinal center line of chamber 12 to the front end thereof, in close proximity to the bottom of the chamber. Also aiding in positioning the balls B over the distributor is a semi-circular back plate 47 fixedly secured to the back end of the hopper in concentric relation and close proximity to the distributor.

Hingedly mounted upon the lower end of ball feed sleeve 42 is a closure 48 free to gravitate to an open position thereof, but moving to a closed position when the chamber is pressurized.

Receiver tube 46, at its front end, is fixedly mounted upon a head end cover 50, formed to include a flat, circular plate member 52, the inner surface of which is covered by a gasket 54 of foam rubber or the like, the periphery of which is compressed between plate 52 and an outwardly directed, peripheral flange 56 formed upon the open, front end of the body of the housing or pressurizing chamber 12. Securing cover 50 to the body of the chamber in sealing relation thereto is an expandable clamping ring 58 which is per se conventional, being of the type comprising a split ring element capable of being contracted radially to its clamping position through the provision of a hinged toggle lever and link assembly 60 connected between the ends of the split ring of the clamp.

Close to the front thereof, receiver tube 46 is provided with a peripheral, radially outwardly directed mounting and sealing flange 62, adapted to bear against gasket 54 about a receiver tube mounting opening 64 formed in the gasket and plate constituting cover 50. Sheet metal screws 63 or the like extend through flange 62 and plate 52, compressing gasket 54 between the flange and plate about the mounting opening 64, to sealably secure the tube to the cover 50.

Above tube 46, the cover 50 is formed with an air inlet opening 66, through which air is drawn into chamber 12 by a blower 68 mounted against the inner surface of the cover 50. An air intake space is defined at 70 forwardly of the air inlet opening 66, between a pair of forwardly projecting, approximately triangular, transversely spaced, flat discharge tube mounting plates 72 fixedly attached to cover plate 52. The air intake space 70 is defined through the provision of the plates 72 and a cross plate 73 affixed to and extending between said plates 72, the plate 73 having an air inlet port 74. The enclosed space 70 has a sound deadening effect, and in a commercial embodiment would preferably be lined with a material designed to absorb the sound of the blower motor to the maximum extent to promote quietness of operation of the air propulsion device.

Figure 6:
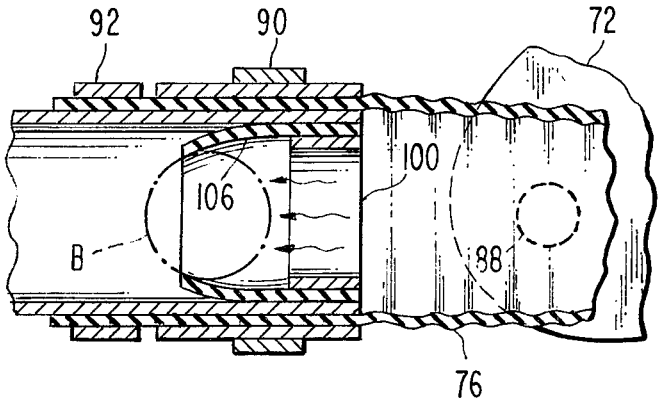
FIG. 6 is a view similar to FIG. 5, in which the detent is shown in position arresting a ball, the ball being shown in dotted lines.
Figure 5:
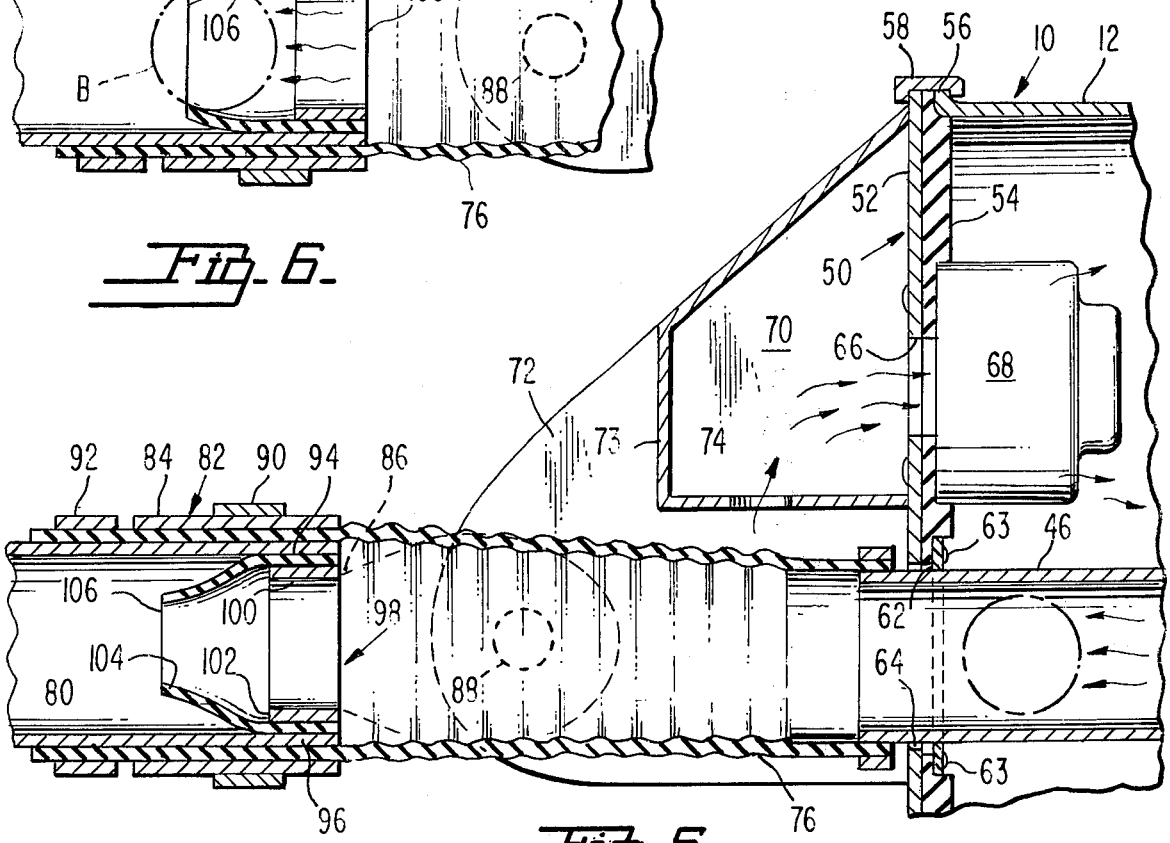
FIG. 5 is an enlarged, fragmentary longitudinal sectional view substantially on line 5—5 of FIG. 4, showing the detent as it appears prior to engagement of the same by a ball that is to be propelled from the barrel.
Figure 7:
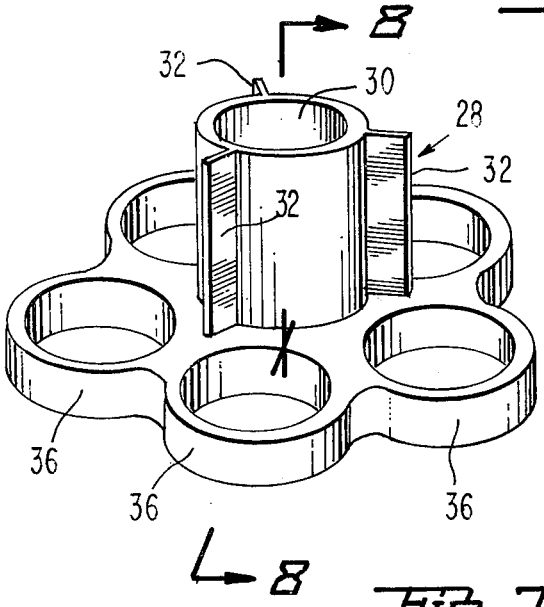
FIG. 7 is a perspective view of the distributor per se.
Figure 8:
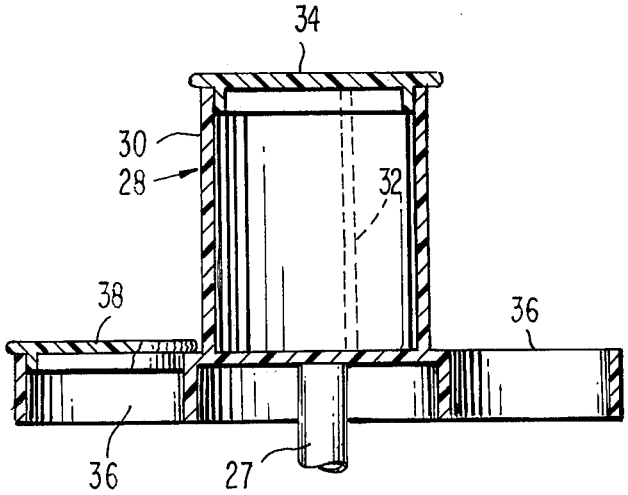
FIG. 8 is a sectional view taken diametrically through the distributor, substantially on line 8—8 of FIG. 7.

As seen from FIGS. 5 and 6, a flexible discharge tube 76, which can conveniently comprise a length of corrugated hose or the like, is clamped at 78, at its rear end, to the forwardly projecting end of receiver tube 46 in full communication with the receiver tube. Discharge tube 76, at its front end, projects forwardly beyond the mounting plates 72, and its front end receives the inlet end of an elongated, rigidly constituted barrel 80 opened into communication with discharge tube 76. A pair of identical but opposite barrel support plates is provided, each of which includes an elongated part-cylindrical clamping sleeve element 84 integral at one end with an ear 86 apertured to receive a hinge pin 88 extending between the front ends of mounting plates 72. At 90, I have illustrated a ring clamp, conventional per se, extending about the barrel support plates to clamp the same about the discharge tube 76 and barrel 80 in the overlapped area thereof.

To further, sealably secure the discharge tube to the barrel received therein, there is provided a second ring clamp 92 disposed forwardly of the clamping sleeve elements 84 in direct contact with the discharge tube, assuring positively against leakage of air through the joint between the flexible discharge tube 76 and barrel 80.

Removably press fitted at 94 within the rear end 96 of barrel 80 is a detent assembly 98 constituted by a metal detent sleeve 100 adhesively or otherwise permanently bonded to the inner surface of the rear end of a soft rubber, cylindrical, ball retainer member 104, the front end 106 of which projects beyond sleeve 100, and is normally radially contracted (see FIG. 5) by reason of its inherent resiliency, to a diameter substantially less than that of the ball B to be propelled through the device. An oscillator such as shown in my co-pending application Ser. No. 637,618, filed December 4, 1975, has been designated 0 and while not constituting a part of the present invention, is illustrated as being attachable to the discharge end of the barrel to indicate the adaptability of the present invention for use with said oscillator or equivalent device for varying the direction of travel of balls discharged in successively following order from the machine constituting the present invention.

Operation

In use, the device is particularly adapted as propulsion equipment for tennis balls B. It may be positioned at or adjacent an end of a tennis court, with barrel 80 adjusted upwardly or downwardly (in FIG. 1 the barrel is shown in full and in dotted lines in two of many positions to which it could be adjusted), until it is at a selected angle of inclination desired by the user. Hinge pin 88 is then tightened, as for example through the provision of wing nut 108, to retain the barrel in the selected position of adjustment. When adjusted to a steep angle as shown in full lines in FIG. 1, the barrel will discharge balls upwardly at a corresponding angle, to give a player located at the opposite end of the tennis court practice in returning lobs. Or, when lowered as for example to the dotted line position of FIG. 1, the barrel will be located to discharge the tennis balls at a much lower trajectory, simulating hard forehand or backhand shots. If oscillator 0 is used, successively following balls will be discharged to the opposite corners of the court, thus to cause the player to be required to traverse the width of the court, hitting, in succession, practice forehand and backhand shots. With the device properly located and the barrel at the selected angle of inclination, a power cord 110 is plugged into a suitable outlet, not shown, to provide power for both the gear motor and the blower. An on-off switch 112 is moved to "on" position to supply power to the motors.

Gear motor 24 operates to rotate distributor 28 at relatively low speed. Typically, the distributor may be caused to rotate through a single 360° cycle each 12 seconds. In a distributor having six holes, as shown by way of example in the illustrated embodiment, a ball will be caused to drop through feed opening 40 and ball feed sleeve 42 once every 2 seconds, assuming that all holes of the distributor are left open. Capping every other distributor sleeve 36 would thus produce discharge of a ball at four second intervals. Other intervals can be selected by other capping patterns.

As the distributor rotates, the several openings thereof will be charged with tennis balls, as they move toward registration with feed opening 40, with increased assurance of full charging of the distributor being given through the anti-bridging and agitating means 30, 32, and even more importantly by the up-and-down motion of the balls within the distributor sleeves.

When the blower (which could be a typical motor and blower such as used in ordinary domestic vacuum sweepers) is in operation, air will be drawn into the pressurizing chamber 12. The air, as it pressurizes the chamber, normally tends to bias closure 48 to the closed, dotted line position shown in FIG. 1.

A ball gravitating through the sleeve 42 has a gravitational force overcoming the tendency of the closure to remain in its closed position, so that the door swings to the full line position of FIG. 1 and thus allows the ball to drop to channel 44. The ball enters the rear end of the receiver tube 46. As a result, air that would normally tend to flow out of the chamber 12 through receiver tube 46 has its passage blocked. This causes the air to be diverted toward the drop pipe or feed sleeve 42, as a result of which the diverted flow of air forces the closure 48 to its dotted line, closed position.

The movement of the closure to open position and back to its normal closed position is very rapid, indeed almost a snap action. The ball has free fall in a path directly normal to the plane of the closed trap door, so as to snap it to open position. The door does not impede the free fall of the ball, moving to an open position completely to one side of said path. Further, the ball does not impede the immediate return of the door to a closed position under pressure of the air induced into the drum, since the ball falls to a position on the ramp completely clear of the path of swinging movement of the trap door.

Air pressure in back of the ball that has entered the receiver tube is thus built up, so as to push the ball along the receiver tube until it reaches the radially contracted detent or retainer member 104. Member 104 restrains the ball until the air pressure in back of the ball builds up to a predetermined value. In a typical, commercial embodiment, three pounds of air pressure has been found wholly adequate for this purpose. When the air pressure builds up to this extent, the ball is suddenly forced through the detent and propelled with great force out of the barrel 80.

The discharge of the ball from the barrel of course now opens the receiver tube to the free passage of air therethrough, for a moment. As a result, the closure gravitates to an open position, substantially simultaneously with or just in advance of dropping of another ball into the feed channel, causing repetition of the propulsion cycle previously described herein.

I claim:

1. In a propulsion device for spherical objects, of the type including a discharge barrel, a communicating drum in which air pressure is built up behind each of said objects for propelling the same forcibly from the barrel, and a trap door normally closing an opening into said drum by air pressure within the drum, the improvement comprising: means mounting the trap door and defining said opening into said drum so that a spherical object fed into the drum through said opening will build up kinetic energy while in free fall vertically downwardly through said mounting means into the drum to an extent effective to momentarily bias the door to a substantially vertical open position while said object is still in free fall said trap door, in so opening, momentarily inhibiting free fall of the spherical object; and means within the drum to which said object, while regaining substantially free fall, will gravitate clear of the trap door, so as to permit an immediate return of the trap door to a closed position free of any restraint imposed thereon by the spherical object.

2. In a propulsion device for spherical objects, the improved construction set forth in claim 1, wherein said trap door mounting means comprises a substantially vertical feed tube within the drum, having a lower end on which the trap door is hingedly supported.

3. In a propulsion device for spherical objects, the improvement set forth in claim 1 wherein the means for mounting the trap door comprises a substantially vertical feed tube havng an upper end secured to the drum in registration with a feed opening formed in the drum, said feed tube being of a length such as to cause an object passing through the tube to build up said kinetic energy by free gravitational fall through the tubes, the tube having a lower end to which the trap door is hingedly connected.

4. In a propulsion device for spherical objects, the improved construction set forth in claim 1 wherein the means for mounting the trap door comprises a feed tube disposed in an substantially vertical position within the drum, the feed tube having an upper end secured to the drum in registration with a feed opening formed in a wall of the drum, the feed tube having a lower end to which the trap door is hingedly connected, the upper and lower ends of the feed tube being spaced apart in a vertical direction a distance such as to cause objects passing through the feed opening to build up kinetic energy while in free fall through the tube, to an extent to cause the falling objects passing through the feed tube to forcibly bias the trap door to open position, said means to which said objects gravitate clear of the trap door within the drum comprising a ramp spaced vertically from and below the trap door a distance such that objects moving past the trap door will continue in free fall past said trap door onto the ramp without imposing any restraint upon the trap door tending to restrict the same in its movement to its normal, closed position.

5. In a propulsion device for spherical objects, the improvement of claim 4 wherein the trap door, when in its open position, is supported substantially in a vertical plane at one side of the feed tube, wholly clear of the gravitational path through which said spherical objects fall through the tube past the trap door onto said ramp.

6. In a propulsion device for spherical objects of the type including a discharge barrel, a hopper for holding a quantity of said objects, a pressurized drum disposed below the hopper in communication with the barrel, and a rotating distributor for sequentially feeding said objects into the drum from the hopper, said drum having a curved top wall and said distributor having an annular series of feed sleeves carrying said objects into position to be fed into the drum, the improvement comprising: a feed opening formed in said top wall of the drum at a location such that said sleeves will be moved in succession into registration therewith for passage of said objects from the sleeves through said opening into the drum; and means mounting the distributor with the sleeves disposed in a plane approximately tangential to said curved top wall of the drum, said sleeves being bottomless and cooperating with the curved top wall of the drum to permit objects supported therein to move upwardly and downwardly therewithin, and to permit said objects to be individually rotated, during rotation of the distributor with said sleeve-supported objects in contact with the top wall of the drum, thus to agitate the spherical objects within the hopper disposed above the distributor in contact with the objects located within the distributor sleeves.

7. In a propulsion device for spherical objects, the improved construction of claim 6, and said hopper being vertically spaced from the drum, the sleeves of the distributor being disposed substantially wholly in the space between the hopper and drum.

8. In a propulsion device for spherical objects, the improved construction of claim 6 wherein the hopper is spaced upwardly from the drum and has a bottom wall formed with a circular opening, said distributor being mounted for rotation within said opening of the bottom wall of the hopper, the feed sleeves being disposed substantially wholly within the space between the hopper and drum.

9. In a propulsion device for spherical objects, the improved construction of claim 6 wherein the distributor includes an upstanding projection centrally formed thereof, said projection extending upwardly within the hopper and including a circumferential series of radially, outwardly projecting agitator ribs for agitating spherical objects within the hopper.

10. In a propulsion device for spherical objects, the improved construction of claim 6 wherein the hopper is spaced upwardly from the drum, said annular series of feed sleeves of the distributor occupying substantially the full depth of the space between the hopper and drum.

11. In a propulsion device for spherical objects, the improved construction of claim 6 wherein the hopper is spaced upwardly from the drum and has a flat bottom wall in close proximity to the curved top wall of the drum, the distributor sleeves occupying substantially the entire space between the bottom wall of the hopper and said curved top wall of the drum, the distributor sleeves having open upper ends disposed substantially in the plane of the bottom wall of the hopper, said bottom wall of the hopper having a circular opening in which the distributor is rotatably mounted.

12. In a propulsion device for spherical objects, the improved construction set forth in claim 11, wherein the distributor has an upstanding projection formed with a circumferential series of radially outwardly projecting, vertically extending ribs for agitating spherical objects disposed within the hopper.

13. In a propulsion device for spherical objects, the improved construction of claim 6, further including removable caps individually applicable to close selected one of the sleeves for varying the timing of the feed of spherical objects into the drum during rotation of the distributor.

14. In a propulsion device for spherical objects, the improved construction set forth in claim 6, wherein said hopper is spaced upwardly from the drum in close proximity thereto, the hopper having a flat bottom wall formed with a large, circular opening, the distributor including a flat base portion in which said sleeves are formed, said base portion occupying substantially the entire space between the bottom wall of the hopper and the top wall of the drum with the base portion having a flat top surface disposed substantially in the plane of the bottom wall of the hopper, said base portion of the distributor including a flat bottom surface disposed in close proximity to the top wall of the drum, the feed opening of the drum being disposed in the area of the top wall of the drum closest to the plane of the bottom surface of the distributor.

* * * * *